United States Patent [19]

Coldren

[11] 4,421,375

[45] Dec. 20, 1983

[54] FLAG-TYPE TERMINAL HAVING INSULATION DISPLACEMENT WIRE CONNECTION

[75] Inventor: Daniel R. Coldren, Enola, Pa.

[73] Assignee: AMP Incorporated, Harrisburg, Pa.

[21] Appl. No.: 362,772

[22] Filed: Mar. 29, 1982

[51] Int. Cl.[3] ..... H01R 4/24

[52] U.S. Cl. ..... 339/97 R; 339/258 S; 339/276 F

[58] Field of Search ..... 339/97 R, 97 C, 98, 339/99 R, 256 SP, 258 S, 276 F, 97 P

[56] References Cited

U.S. PATENT DOCUMENTS

| | | | |
|---|---|---|---|
| 3,120,990 | 2/1964 | Kinkaid | 339/258 S |
| 3,539,707 | 11/1970 | Kindell et al. | 339/97 C |
| 3,546,664 | 12/1970 | De Bolt et al. | 339/276 F |
| 4,277,124 | 7/1981 | Loose et al. | 339/99 R |
| 4,385,794 | 5/1983 | Lucius | 339/97 R |

FOREIGN PATENT DOCUMENTS

| | | | |
|---|---|---|---|
| 7501838 | 8/1976 | Netherlands | 339/97 P |

*Primary Examiner*—Eugene F. Desmond
*Assistant Examiner*—Gary F. Paumen
*Attorney, Agent, or Firm*—Frederick W. Raring

[57] ABSTRACT

Flag-type terminal comprises a contact portion and a wire connecting portion. The wire connecting portion has a pair of spaced apart plate-like members connected at one end by integral straps. The plate-like members have aligned wire-receiving slots. Each plate-like member has an integral crimpable portion which is crimped onto a wire when the wire is inserted into the slots. The contact portion extends laterally from one of the connecting strap members.

7 Claims, 4 Drawing Figures

FLAG-TYPE TERMINAL HAVING INSULATION DISPLACEMENT WIRE CONNECTION

FIELD OF THE INVENTION

This invention relates to flag-type electrical terminals and particularly to a flag-type terminal having a wire connecting portion which has wire-receiving slots and a crimpable section for holding an inserted wire in the wire-receiving slots.

BACKGROUND OF THE INVENTION

It is common practice to provide on electrical terminals of various types a wire connecting portion comprising a pair of spaced apart plate-like members which are connected to each other by parallel connecting straps. The plate-like members have aligned wire-receiving slots so that an insulated wire can be connected to the terminal by merely moving the wire laterally of its axis and into the wire-receiving slots. The edges of the slots penetrate the insulation of the wire and establish electrical contact with the conducting core. So long as the wire is not violently disturbed, an electrical connection of this type will remain stable and effective over an extremely long time period.

A common type of terminal usually referred to as a flag-type terminal has a contact portion such as a receptacle for a terminal tab which extends laterally of a wire to which the terminal is attached. In the past it has not been practical to provide flag-type terminals with insulation displacement wire connecting portions as described above. The electrical connection in flag-type terminal is subject to somewhat more abusive handling than the electrical connection between a wire and a conventional in-line terminal and it is probably for this reason that insulation displacement type connections have not been used for flag-type terminals in the past. Additionally, it is difficult to provide a contact portion of a flag-type terminal which extends laterally of a contact portion of the insulation displacement type. Terminals of the types under consideration are manufactured by stamping and forming sheet metal into the configuration required and it is difficult to produce by stamping and forming an insulation displacement type terminal having its contact portion extending laterally of a wire received in the wire connecting portion.

The present invention is directed to the achievement of flag-type terminals having insulation displacement type connecting portions for forming the electrical connections between a wire and the terminal and is further directed to a terminal having improved means for stabilizing the wire after it has been inserted into the terminal and to an improved terminal structure for flag-type terminals.

A flag-type terminal in accordance with the invention has a wire connecting portion and a contact portion which extends laterally of the wire connecting portion. A terminal in accordance with the invention is particularly characterized in that the wire connecting portion comprises a pair of spaced apart aligned plate-like members, each of the members having a first end and a second end, the first ends being connected by spaced apart connecting straps. Aligned wire-receiving slots extend into the plate-like members from the first ends whereby a wire can be moved laterally of its axis between the connecting straps, and into the wire-receiving slots. The wire connecting portion is integral with, and extends laterally from, one of the connecting straps.

In accordance with a further embodiment, at least one crimpable strain relief device is provided on the terminal, the strain relief device being integral with, and extending from, the second end of one of the plate-like members. In accordance with a further embodiment, the contact portion is connected to the one connecting strap by a connecting section which extends from the one connecting strap towards the second ends of the plate-like members, the contact portion extending from the connecting section at a location proximate to the second ends of the plate-like members. In accordance with a further embodiment, the contact portion extends directly from the connecting strap.

DRAWING FIGURES

THE PREFERRED EMBODIMENTS

Figure 1:
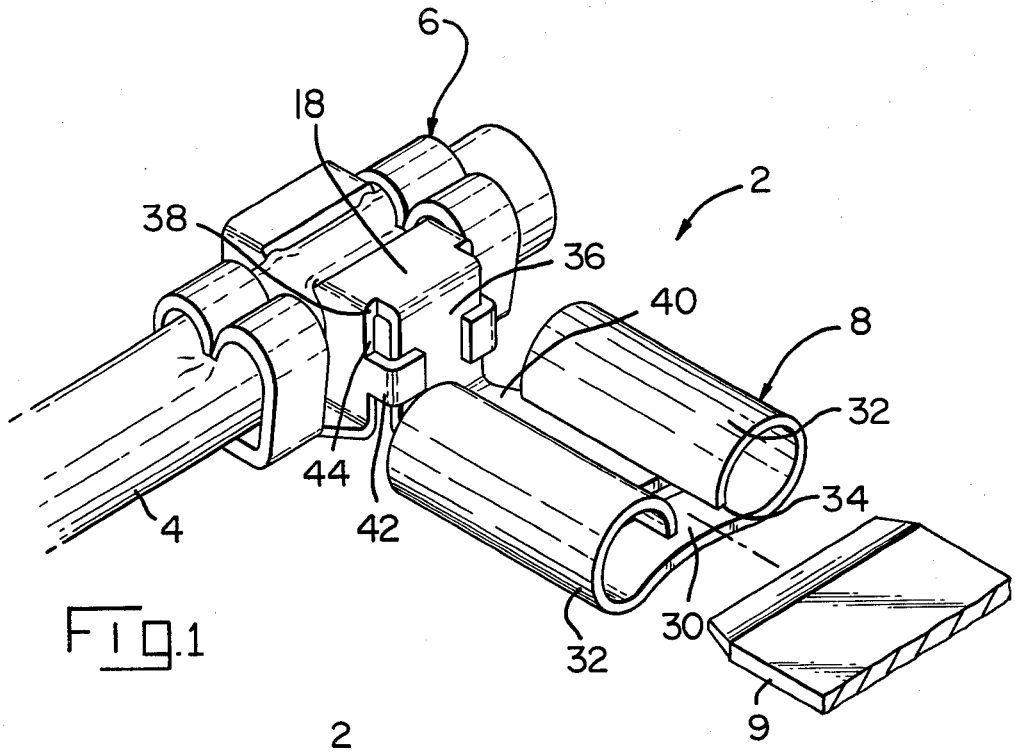
FIG. 1 is a perspective view of a terminal in accordance with the invention connected to an insulated wire.
Figure 2:
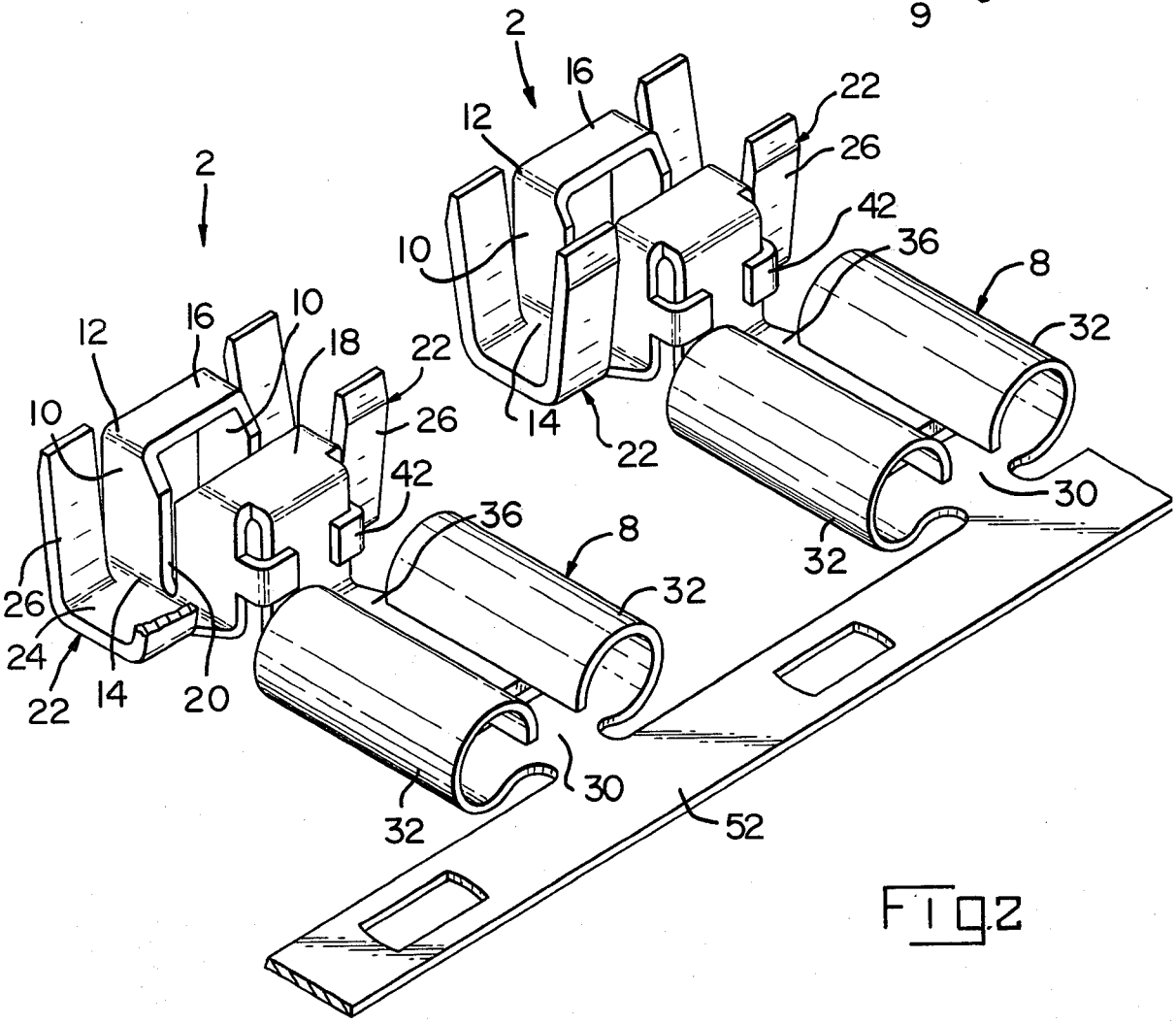
FIG. 2 is a perspective view of a short section of a terminal strip.

A terminal 2, FIG. 1, in accordance with the invention comprises a wire connecting portion 6 and a contact portion 8, the wire connecting portion being connected to an insulated wire 4. The wire connecting portion comprises a pair of parallel spaced apart plate-like members 10, FIG. 2, each of which has a first or upper end 12 and a second or lower end 14. The first ends are connected to each other by parallel spaced apart connecting straps 16, 18. Wire-receiving slots 20 are provided in the plate-like members 10 and are located centrally between the side edges of these members. The wire 4 can thus be moved laterally of its axis between the spaced-apart connecting straps 16, 18 and into the slots 20.

Crimpable strain reliefs 22 are provided on each of the plate-like members 10, each strain relief being generally U-shaped, having a web or base 24 and arms 26 which extend from the side edges of the base. The web is integral with its associated plate-like member 10 at the lower end 14 of the plate-like member.

When the wire 4 is to be connected to the terminal, it is moved into the slots 20 as previously explained and the arms 26 to both of these strain relief devices 22 are crimped inwardly towards each other and downwardly onto the wire. The crimped strain relief devices have a stabilizing effect on the wire adjacent to each of the plate-like members 10 and thereby prevent any disturbance to the wire or the contact portion of the terminal from being transmitted to the electrical interface of one conducting core of the wire and the edges of the slots 10.

The contact portion 8 of the described embodiment is in the form of a receptacle which is dimensioned to receive a conventional terminal tab 9. Contact portion 8 thus comprises a base or web 30 and sidewalls 32 which are curled inwardly and towards each other so that their edges 34 are opposed to the surface of the web 30. The receptacle portion is connected to the strap member 18 by a connecting section 36 which extends from the outside edge 38 of the strap 18. Connecting section 36 extends downwardly and is integral at 40 with the inner end of the web 30 of the receptacle.

In order to stabilize the contact portion 8 relative to the connecting portion 6 of the terminal, a pair of restraining ears 42 are provided which extend from the edges 44 of the plate-like members 10. These ears 42 are bent inwardly towards each other and extend over the surface of the connecting section 36.

Figure 3:
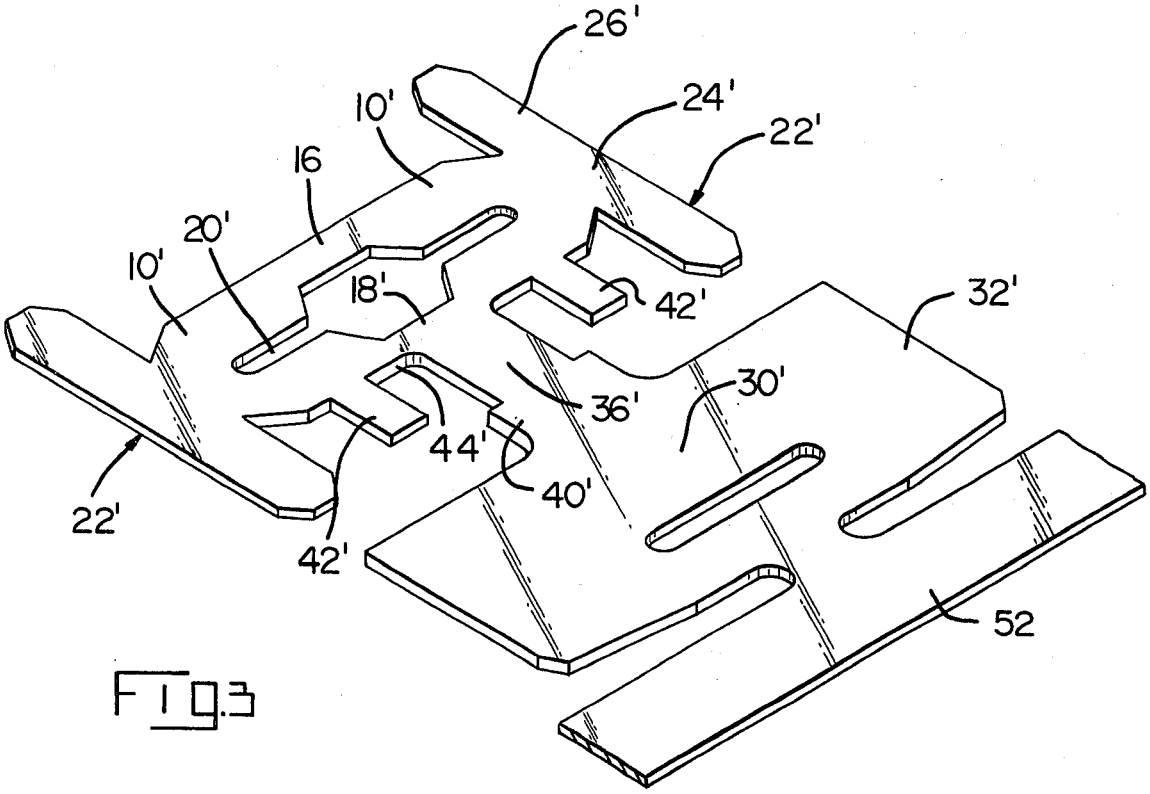
FIG. 3 is a perspective view of a flat blank from which a terminal in accordance with the invention is formed.

FIG. 3 shows the flat blank from which the terminal 2 is produced. The parts of the blank are identified by the same referenced numerals, differentiated by prime marks as are used in the description of the terminal. The terminals are produced in continuous strip form with each terminal integral with a carrier strip 52.

Figure 4:
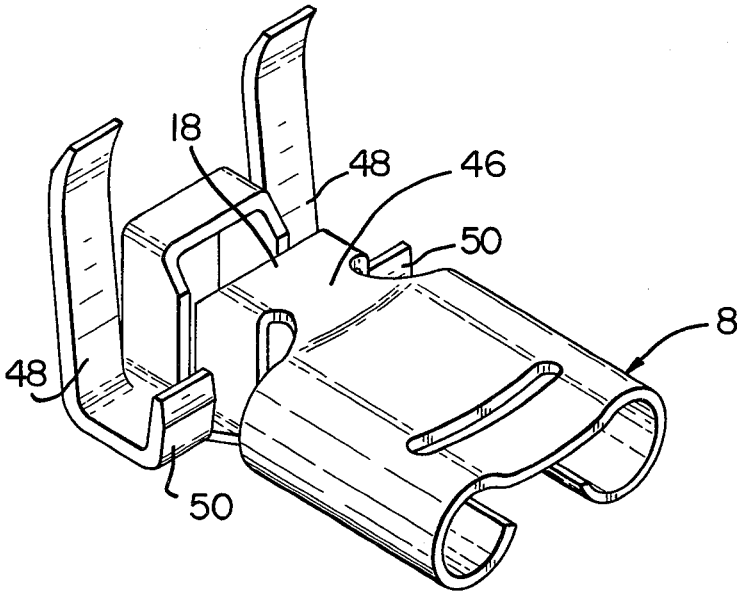
FIG. 4 is a perspective view of an alternative embodiment.

FIG. 4 shows an alternative embodiment in which the contact portion 8 is connected to the strap 18 by a relatively short connecting section 46. In this embodiment, one of the arms 50 of each crimpable section is relatively shorter than the other arm 48. This feature is necessary because of the fact that there is less material for the formation of the arm 50 in this embodiment than in the embodiment FIGS. 1–3.

What is claimed is:

1. A flag-type terminal of the type having a wire connecting portion and a contact portion which extends laterally of the wire connecting portion, the terminal being characterized in that:

the wire connecting portion comprises a pair of spaced apart aligned plate-like members, each of the members having a first end and a second end, the first ends being connected by spaced apart connecting straps, aligned wire-receiving slots extending into the plate-like members from the first ends whereby a wire can be moved between the connecting straps, and into the wire-receiving slots, the contact portion being integral with, and extending laterally from, one of the connecting straps.

2. A flag-type terminal as set forth in claim 1 characterized in that at least one crimpable strain relief device is provided on the terminal, the strain relief device being integral with, and extending from, the second end of one of the plate-like members.

3. A flag-type terminal as set forth in either of claims 1 or 2 characterized in that the contact portion is connected to the one connecting strap by a connecting section, the connecting section extending from the one connecting strap towards the second ends of the plate-like members, the contact portion extending from the connecting section at a location proximate to the second ends of the plate-like members.

4. A flag-type terminal as set forth in claim 3 characterized in that the side edges of the plate-like members which are proximate to the connecting section have restraining ears extending therefrom, the restraining ears extending partially around the connecting section and restraining the connecting section against movement away from the plate-like members.

5. A flag-type terminal as set forth in claim 2 characterized in that a crimpable strain relief device is provided in each of the plate-like members at the second end thereof, each crimpable strain relief device being generally U-shaped having a web and arms extending from the side edges of the web, the arms being crimpable onto a wire positioned in the slots.

6. A flag-type terminal as set forth in either of claims 1 or 5 characterized in that the contact portion is a contact receptacle which is dimensioned to receive a tab terminal.

7. A flag-type terminal as set forth in claim 6 characterized in that the contact receptacle has a web portion and sidewalls which are inwardly curled towards each other and towards the web portion, the web portion extending directly from the one connecting strap.

* * * * *